US006844815B2

(12) United States Patent
Chang

(10) Patent No.: US 6,844,815 B2
(45) Date of Patent: Jan. 18, 2005

(54) RETRACTABLE HANDLE BAR ASSEMBLY WITH SAFETY ALERT SYSTEM FOR TRAVELING CONTAINER

(76) Inventor: John Nia You Chang, 869 Country Rd., Monterey Park, CA (US) 91755

( * ) Notice: Subject to any disclaimer, the term of this patent is extended or adjusted under 35 U.S.C. 154(b) by 101 days.

(21) Appl. No.: 10/409,990

(22) Filed: Apr. 7, 2003

(65) Prior Publication Data

US 2004/0196154 A1 Oct. 7, 2004

(51) Int. Cl.[7] ..... G08B 13/14

(52) U.S. Cl. ..... 340/568.6; 340/568.7; 340/571

(58) Field of Search ..... 340/568.1, 568.5, 340/568.6, 568.7, 571; 190/115, 18 A; 16/113.1, 114.1, 115

(56) References Cited

U.S. PATENT DOCUMENTS 4,118,692 A * 10/1978 Fitchett ..... 340/542
5,184,110 A * 2/1993 Horng ..... 340/571
5,630,521 A * 5/1997 Waddell et al. ..... 190/18 A
5,816,375 A * 10/1998 Tu ..... 190/115
6,133,831 A * 10/2000 Kyles ..... 340/571
6,137,410 A * 10/2000 Sepulveda ..... 340/568.7
6,181,246 B1 * 1/2001 Ewing et al. ..... 340/571
6,515,588 B1 * 2/2003 Sarabia ..... 340/568.1
6,564,426 B1 * 5/2003 Wang ..... 16/113.1

* cited by examiner

*Primary Examiner*—Van T. Trieu
(74) *Attorney, Agent, or Firm*—Raymond Y. Chan; David and Raymond

(57) ABSTRACT

A retractable handle bar assembly incorporated with a traveling container includes a hand bar having a receiving cavity, a retractable arm for slidably folding the hand bar between a folded position and an unfolded position, locking device for locking the hand bar at the folded position, and a safety alert system, which is received in the receiving cavity of the hand bar, including an alert signal generator arranged in such a manner that when the hand bar is unlocked to slid from the folded position, the alert signal generator is activated to produce alert signals for aiding an attention of the container body.

20 Claims, 4 Drawing Sheets

RETRACTABLE HANDLE BAR ASSEMBLY WITH SAFETY ALERT SYSTEM FOR TRAVELING CONTAINER

BACKGROUND OF THE PRESENT INVENTION

1. Field of Invention

The present invention relates to a traveling container, and more particularly to a safety alert system for a traveling container, wherein the safety alert system is incorporated with a retractable handle bar assembly of the traveling container for providing an alert signal, thereby aiding to increase safety.

2. Description of Related Arts

Traveling containers are considered as one of the useful tools for traveling. A conventional container such as a fabric type carrying baggage or a metal type carrying case has several drawbacks. One of the problem with the conventional carrying container is that they are bulky, usually heavy, and difficult to carry. In other words, the carrying container is immobilized at all times such that the user usually picks up the carrying container when he or she has to move from place to place. Therefore, such carrying container usually incorporates with a retractable handle bar assembly such that the user is able to easily carry the carrying container by slidably extending a hand bar of the retractable handle bar assembly.

In addition, when the user waits for the check in at the airport, he or she will usually put the carrying container aside until the departure time comes, so that the carrying container will be stolen easily. In other words, there is no alert system incorporated with the conventional carrying container to prevent the carrying container from being unintentionally stolen.

Moreover, all the conventional carrying containers are looked similar, the user may merely pick up a wrong carrying container that is not belong to him or her. Therefore, there are thousands of carrying containers lost at the airport everyday while the carrying containers are either taken by fault or stolen.

SUMMARY OF THE PRESENT INVENTION

A main object of the present invention is to provide a retractable handle bar assembly with a safety alert system for a traveling container, wherein the safety alert system is arranged to be activated to provide an alert signal for the traveling container, thereby aiding to increase safety.

Another object of the present invention is to provide a retractable handle bar assembly with a safety alert system for a traveling container, wherein the safety alert system additionally provides added visibility and/or audibility to the traveling container, so as to aid the user in notifying the traveling container in attendance.

Another object of the present invention is to provide a retractable handle bar assembly with a safety alert system for a traveling container, wherein the actuation of the retractable handle bar assembly automatically activates the safety alert system so as to substantially increase the safety purpose of the traveling container.

Another object of the present invention is to provide a retractable handle bar assembly with a safety alert system for a traveling container, wherein the safety system is installed into the retractable handle bar assembly such that the traveling container does not require altering its original structural design so as to minimize the manufacturing cost of the traveling container incorporating with the safety alert system.

Another object of the present invention is to provide a retractable handle bar assembly with a safety alert system for a traveling container, wherein no expensive or complicated structure is required to employ in the present invention in order to achieve the above mentioned objects. Therefore, the present invention successfully provides an economic and efficient solution for not only providing a safety alert configuration to the user but also enhancing the appearance and visibility of the traveling container.

Accordingly, in order to accomplish the above objects, the present invention provides a retractable handle bar assembly for a traveling container having a container body, comprising:

a hand bar having a first supporting wall and an opposed second supporting wall defining a receiving cavity therebetween;

means for slidably folding the hand bar between a folded position and an unfolded position, wherein at the folded position, the hand bar is arranged for moving towards the container body, and at the unfolded position, the hand bar is arranged for moving away from the container body;

means for locking the hand bar at the folded position; and a safety alert system, which is received in the receiving cavity of the hand bar, comprising an alert signal generator arranged in such a manner that when the hand bar is unlocked to slid from the folded position, the alert signal generator is activated to produce alert signals for aiding an attention of the container body.

These and other objectives, features, and advantages of the present invention will become apparent from the following detailed description, the accompanying drawings, and the appended claims.

DETAILED DESCRIPTION OF THE PREFERRED EMBODIMENT

Figure 1:
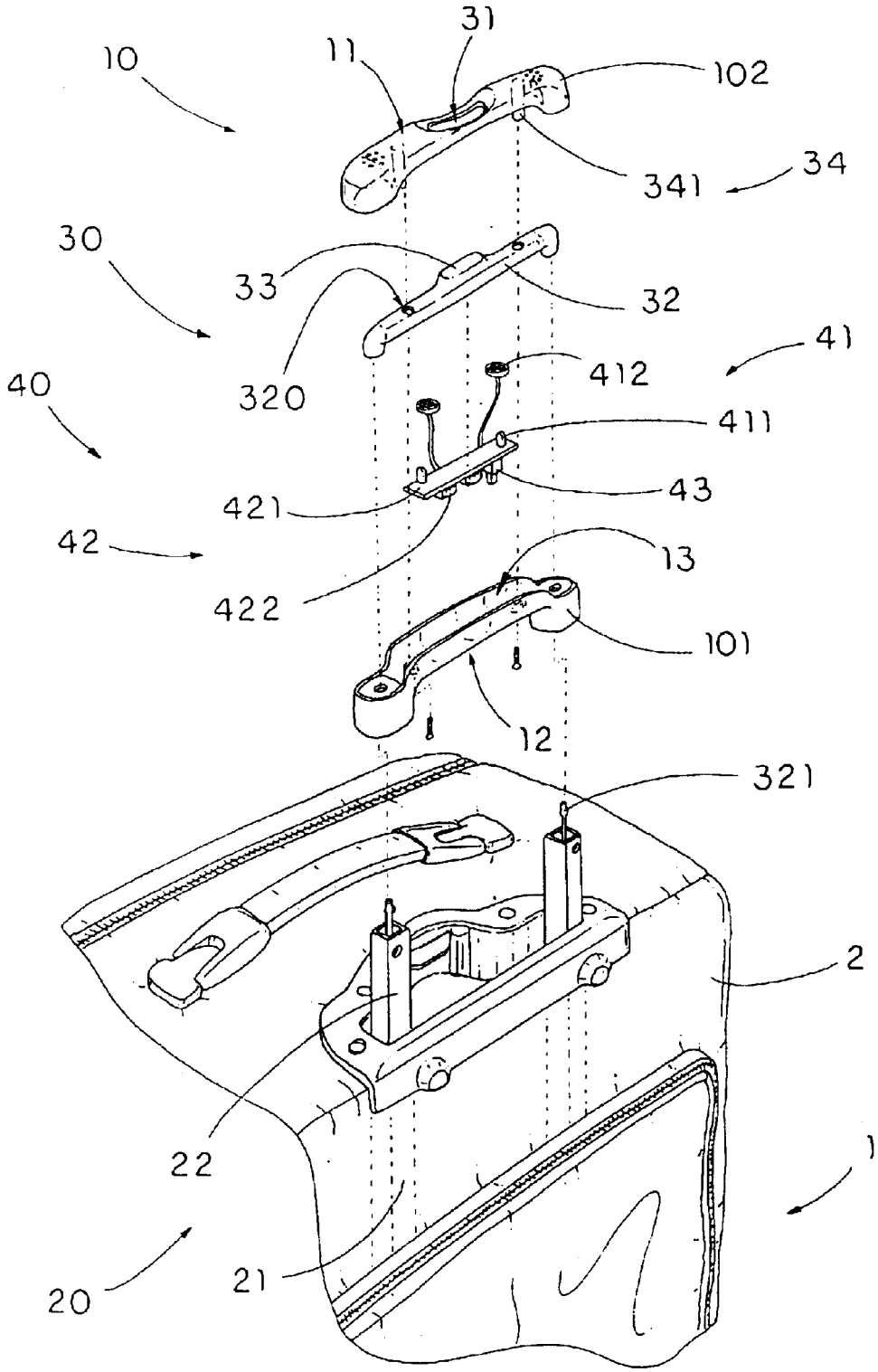
FIG. 1 is an exploded perspective view of a safety alert system incorporated with a retractable handle bar assembly of a traveling container according to a preferred embodiment of the present invention.

Referring to FIG. 1 of the drawings, a retractable handle bar assembly for a traveling container 1 is illustrated, wherein the traveling container 1, such as a conventional traveling container, having a container body 2 constructed by a plurality of fabric made container panels connected in an edge-to-edge manner so as to define a storage cavity within the container panels.

The retractable handle bar assembly comprises a hand bar 10 having a first supporting wall 11 and an opposed second supporting wall 12 defining a receiving cavity 13 therebetween, means 20 for slidably folding the hand bar 10 between a folded position and an unfolded position, wherein at the folded position, the hand bar 10 is arranged for moving towards the container body 2, and at the unfolded position, the hand bar 10 is arranged for moving away from the container body 2, and means 30 for locking the hand bar 10 at the folded position.

The retractable handle bar assembly further comprises a safety alert system 40, which is received in the receiving cavity 13 of the hand bar 10, comprising an alert signal generator 41 arranged in such a manner that when the hand bar 10 is unlocked to slid from the folded position, the alert signal generator 41 is activated to produce alert signals for aiding an attention of the container body 2.

According to the preferred embodiment, the hand bar 10 is made of transparent material such as plastic in such a manner that the safety alert system 40 in the receiving cavity 13 can be seen from outside through the hand bar 10.

As shown in FIG. 1, the hand bar 10 is constructed to have a first casing 101 forming the second supporting wall 12 and a second casing 102 forming the first supporting wall 11 to detachably mount on the first casing 101 to form the receiving cavity 13 within the first and second casings 101, 102.

The folding means 20 comprises a retractable base 21 attached to the container body 2 of the traveling container and a retractable arm 22 slidably extended from the retractable base 21 wherein the hand bar 10 is extended from the retractable arm 22 in such a manner that the retractable arm 22 is downwardly slid with respect to the retractable base 21 to reduce a distance between the hand bar 10 and the container body 2, and at the unfolded position, the retractable arm 22 is upwardly slid with respect to the retractable base 21 to increase the distance between the hand bar 10 and the container body 2.

The locking means 30 of the retractable handle bar assembly has an operation slot 31 formed on the first supporting wall 11 to communicate the receiving cavity 13 with outside and comprises a locking member 32 movably supported within the receiving cavity 13 and an operation button 33 extended from the locking member 32 to outside through the operation slot 31 for operating the locking member 32 to move from a normal locking position to an unlocking position.

The locking member 32 further comprises an arm locker 321 extended from the hand bar 10 to the retractable base 21 through the retractable arm 22 wherein at the locking position, the arm locker 321 normally locks up the retractable arm 22 with the retractable base 21 and at the unlocking position, the operation button 33 is pressed to drive the locking member 32 to release the locking up of the retractable arm 22 with respect to the retractable base 21 through the arm locker 321.

Accordingly, the locking means 30 further comprises a sliding guider 34 supported within the receiving cavity 13 at a position between the first supporting wall 11 and the second supporting wall 12 for guiding the locking member 32 to slide within the receiving cavity 13 so as to guide the locking member 32 moving from the locking position to the unlocking position. The sliding guider 34 comprises a guiding rail 341 extended from the first supporting wall 11 to the second supporting wall 12 through a through hole 320 formed on the locking member 32 such that when a pressing force is applied on the operation button 33, the locking member 32 is driven towards the second supporting wall 12 to release the locking up of the retractable arm 22 with respect to the retractable base 21.

According to the preferred embodiment, the safety alert system 40 further comprises an electric circuit 42 which is supported by the locking member 32 within the receiving cavity 13 and is electrically connect with the alert signal generator 41, and a control switch 43 connected to the electric circuit 42 and arranged in such a manner that when the locking member 32 is actuated to automatically actuate the control switch 43, the alert signal generator 41 is activated to produce the alert signals.

Accordingly, the electric circuit 42 is configured that the alert signal generator 41 is preset to produce the alert signals for a predetermined time period. Alternatively, the control switch 43 is actuated to activate the alert signal generator 41 for producing the alert signals and to deactivate the alert signal generator to stop producing the alert signals in a sequence manner.

Figure 3:
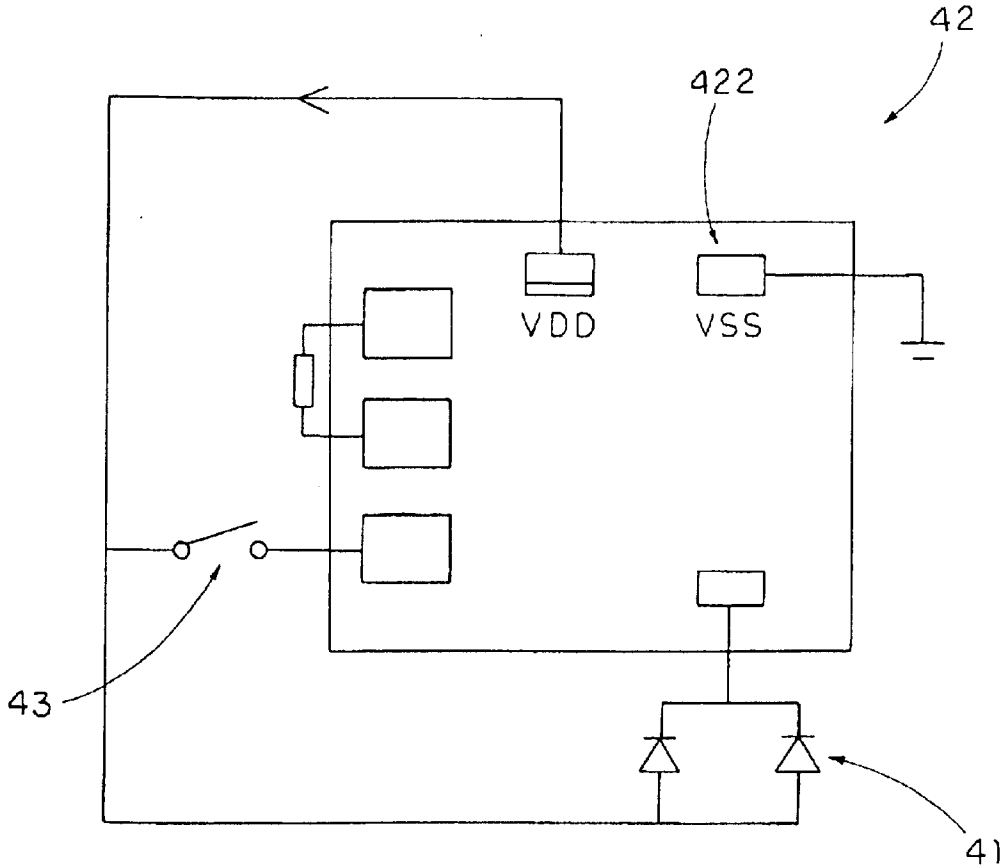
FIG. 3 is a circuit diagram of the safety alert system according to the above preferred embodiment of the present invention.

FIG. 3 illustrates an electric diagram of the electric circuit 42 wherein the electric circuit 42 comprises an IC board 421 supported by the locking member 442 and a power source 422 electrically mounted on the IC board 421. According to the preferred embodiment, the power source 422 is a replaceable battery mounted on the IC board 421 for providing electricity.

Figure 2:
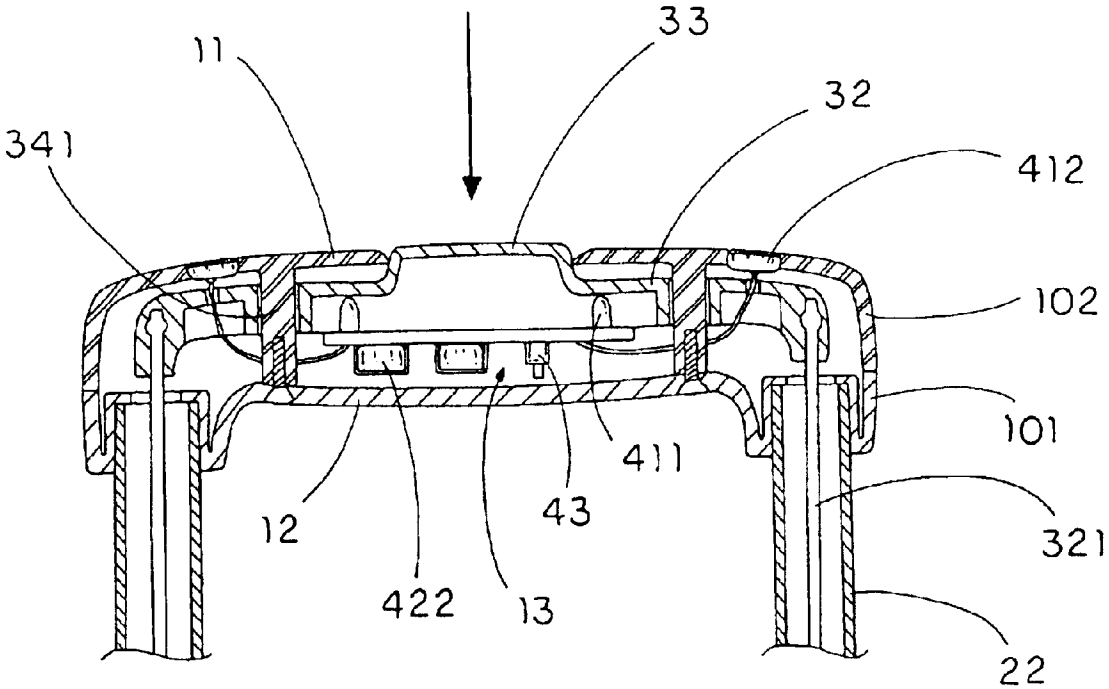
FIG. 2 is a sectional view of the safety alert system incorporated with the retractable handle bar of the traveling container according to the above preferred embodiment of the present invention.

As shown in FIG. 2, the control switch 43 is a depressible button electrically mounted on the electric circuit 42 at a position towards the second supporting wall 12 in such a manner that when the operation button 33 is pressed towards the receiving cavity 13, the control switch 43 is pressed by the second supporting wall 12 so as to activate the alert signal generator 41. In other words, the first and second supporting walls 11, 12 of the hand bar 10 has a predetermined distance that when the user presses the locking member 32 on the first supporting wall 11 to release the locking up of the retractable arm 21, the control switch 43 is pressed on the second supporting wall 12 to activate the alert signal generator 41. Therefore, when the retractable handle bar assembly is actuated to move the container body 2 of the traveling container 1, the safety alert system 40 provides added alert signals to the traveling container 1, so as to aid the user in notifying the traveling container 1 in attendance.

Accordingly, the alert signal generator 41 comprises at least an illuminator 411 electrically mounted on the IC board 421 of the electric circuit 42 wherein the illuminator 411 is arranged to be activated to produce visible signals as the alert signals. The illuminator 411, according to the preferred embodiment, is a LED capable of generating the visible signals as the alert signals to enhance the visibility of the container body 2 so as to increase the safety purpose of the traveling container 1.

As shown in FIG. 2, the alert signal generator 41 further comprises a panic generator 412 electrically mounted on the IC board 421 of the electric circuit 42 wherein the panic generator 412 is arranged to be activated to produce panic signals as the alert signals. In other words, the alert signal generator 41 produces not only visible signals but also panic signals as the alert signals to enhance the safety of the traveling container 1.

Figure 4:
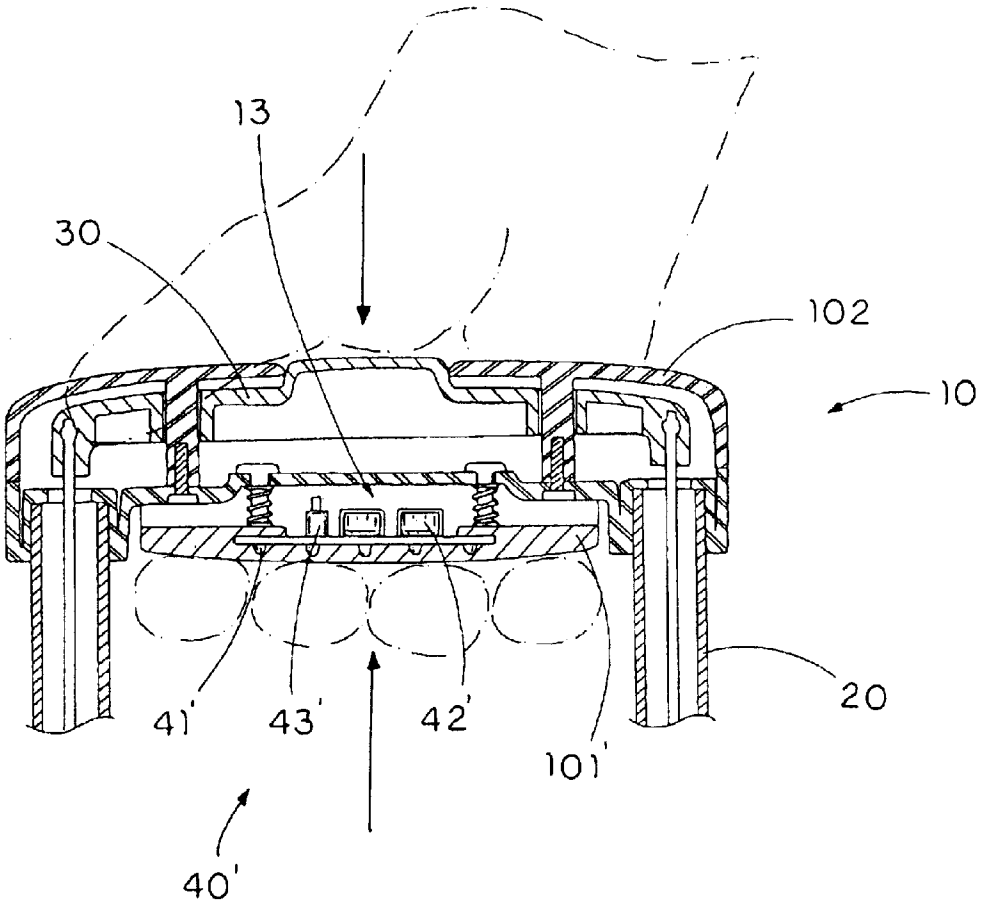
FIG. 4 illustrates an alternative mode of the safety alert system incorporated with the retractable handle bar assembly of the traveling container according to the above preferred embodiment.

FIG. 4 illustrates an alternative mode of the safety alert system 40' which is detachably mounted to the hand bar 10' of the retractable handle bar assembly. As shown in FIG. 4, the first casing 101' of the hand bar 10' is mounted to the folding means 20' wherein the locking means 30' is received in the first casing 101' of the hand bar 10' to form as a conventional retractable handle bar assembly.

The second casing 102' of the hand bar 10', having a U-shaped cross sectional, detachably mount on the first casing 101' in a slidably movable manner to form the receiving cavity 13' within the first and second casings 101', 102', wherein the safety alert system 40' is received in the first casing 101'. Accordingly, the control switch 43' of the safety alert system 40' is a depressible button electrically mounted on the electric circuit 42' at a position towards the first casing 101' in such a manner that when the second casing 102' is pressed towards the first casing 101', the control switch 43' is pressed by the first casing 101' so as to activate the alert signal generator 41'. In other words, since the user must apply a gripping force on the hand bar 10', the gripping force will force the second casing 102' to press towards the first casing 101' to actuate the control switch 43' so as to activate the alert signal generator 41' for producing the alert signals for the traveling container.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure form such principles. Therefore, this invention includes all modifications encompassed within the spirit and scope of the following claims.

What is claimed is:

1. A retractable handle bar assembly for a traveling container having a container body, comprising:

a hand bar having a first supporting wall and an opposed second supporting wall defining a receiving cavity therebetween;

means for slidably folding said hand bar between a folded position and an unfolded position, wherein at said folded position, said hand bar is arranged for moving towards said container body, and at said unfolded position, said hand bar is arranged for moving away from said container body;

means for locking said hand bar at said folded position; and a safety alert system, which is received in said receiving cavity of said hand bar, comprising an alert signal generator arranged in such a manner that when said hand bar is unlocked to slid from said folded position, said alert signal generator is activated to produce alert signals for aiding an attention of said container body.

2. The retractable handle bar assembly, recited in claim 1, wherein said locking means has an operation slot formed on said first supporting wall to communicate said receiving cavity with outside and comprises a locking member movably supported within said receiving cavity and an operation button extended from said locking member to outside through said operation slot for operating said locking member to release said hand bar.

3. The retractable handle bar assembly, as recited in claim 2, wherein said safety alert system further comprises an electric circuit which is supported within said receiving cavity and is electrically connected with said alert signal generator, and a control switch connected to said electric circuit and arranged to be actuated by said operation button to activate said alert signal generator.

4. The retractable handle bar assembly, as recited in claim 3, wherein said control switch is a depressible button electrically mounted on said electric circuit at a position towards said second supporting wall in such a manner that when said operation button is pressed towards said receiving cavity, said control switch is pressed by said second supporting wall so as to activate said alert signal generator.

5. The retractable handle bar assembly, as recited in claim 4, wherein said alert signal generator is preset to produce said alert signals for a predetermined time period.

6. The retractable handle bar assembly, as recited in claim 5, wherein said alert signal generator comprises at least an illuminator electrically connected to said electric circuit to produce visible signals as said alert signals.

7. The retractable handle bar assembly, as recited in claim 5, wherein said alert signal generator comprises a panic generator electrically connected to said electric circuit to produce panic signals as said alert signals.

8. The retractable handle bar assembly, as recited in claim 5, wherein said alert signal generator comprises at least an illuminator and a panic generator electrically connected to said electric circuit to produce visible signals and panic signals respectively as said alert signals.

9. The retractable handle bar assembly, as recited in claim 5, wherein said hand bar comprises a first casing forming said second supporting wall and a second casing forming said first supporting wall to detachably mount on said first casing so as to form said receiving cavity within said first and second casings.

10. The retractable handle bar assembly, as recited in claim 4, wherein said control switch is actuated to activate said alert signal generator for producing said alert signals and to deactivate said alert signal generator to stop producing said alert signals in a sequence manner.

11. The retractable handle bar assembly, as recited in claim 10, wherein said alert signal generator comprises at least an illuminator electrically connected to said electric circuit to produce visible signals as said alert signals.

12. The retractable handle bar assembly, as recited in claim 10, wherein said alert signal generator comprises a panic generator electrically connected to said electric circuit to produce panic signals as said alert signals.

13. The retractable handle bar assembly, as recited in claim 10, wherein said alert signal generator comprises at least an illuminator and a panic generator electrically connected to said electric circuit to produce visible signals and panic signals respectively as said alert signals.

14. The retractable handle bar assembly, as recited in claim 10, wherein said hand bar comprises a first casing forming said second supporting wall and a second casing forming said first supporting wall to detachably mount on said first casing so as to form said receiving cavity within said first and second casings.

15. The retractable handle bar assembly, as recited in claim 4, wherein said alert signal generator comprises at least an illuminator electrically connected to said electric circuit to produce visible signals as said alert signals.

16. The retractable handle bar assembly, as recited in claim 4, wherein said alert signal generator comprises a panic generator electrically connected to said electric circuit to produce panic signals as said alert signals.

17. The retractable handle bar assembly, as recited in claim 4, wherein said alert signal generator comprises at least an illuminator and a panic generator electrically connected to said electric circuit to produce visible signals and panic signals respectively as said alert signals.

18. The retractable handle bar assembly, as recited in claim 4, wherein said hand bar comprises a first casing forming said second supporting wall and a second casing forming said first supporting wall to detachably mount on said first casing so as to form said receiving cavity within said first and second casings.

19. The retractable handle bar assembly, as recited in claim 3, wherein said alert signal generator is preset to produce said alert signals for a predetermined time period.

20. The retractable handle bar assembly, as recited in claim 3, wherein said control switch is actuated to activate said alert signal generator for producing said alert signals and to deactivate said alert signal generator to stop producing said alert signals in a sequence manner.

* * * * *